US008910470B2

(12) United States Patent
Moetakef et al.

(10) Patent No.: US 8,910,470 B2
(45) Date of Patent: Dec. 16, 2014

(54) EXHAUST SYSTEM HAVING A FLOW ROTATION ELEMENT AND METHOD FOR OPERATION OF AN EXHAUST SYSTEM

(71) Applicant: Ford Global Technologies, LLC, Dearborn, MI (US)

(72) Inventors: Mohammad Ali Moetakef, West Bloomfield, MI (US); Steve Poe, Canton, MI (US); Abdullahi Hajiabdi, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 56 days.

(21) Appl. No.: 13/897,223

(22) Filed: May 17, 2013

(65) Prior Publication Data

US 2014/0338308 A1 Nov. 20, 2014

(51) Int. Cl.

| | |
|---|---|
| ***F01N 3/00*** | (2006.01) |
| ***F01N 3/02*** | (2006.01) |
| ***F01N 3/10*** | (2006.01) |
| ***F01N 3/20*** | (2006.01) |
| ***F01N 1/08*** | (2006.01) |
| ***F01N 13/10*** | (2010.01) |

(52) U.S. Cl.

CPC ..... *F01N 1/086* (2013.01); *F01N 13/10* (2013.01)

USPC ..... 60/317; 60/323; 60/324

(58) Field of Classification Search

USPC ..... 60/317, 323, 324

See application file for complete search history.

(56) References Cited

U.S. PATENT DOCUMENTS

| | | | | |
|---|---|---|---|---|
| 4,671,057 | A | 6/1987 | Kronich | |
| 4,924,669 | A | 5/1990 | Tsutsumi | |
| 5,758,614 | A | 6/1998 | Choi | |
| 6,158,412 | A | 12/2000 | Kim | |
| 6,293,236 | B1 * | 9/2001 | De Francisco | 123/79 R |
| 6,425,382 | B1 | 7/2002 | Marthaler et al. | |
| 7,086,498 | B2 | 8/2006 | Choi et al. | |
| 7,104,251 | B2 | 9/2006 | Kim | |
| 7,717,229 | B2 | 5/2010 | Putnam | |
| 8,230,676 | B2 | 7/2012 | Harrer | |
| 2003/0121252 | A1 * | 7/2003 | Huh | 60/302 |
| 2009/0007552 | A1 | 1/2009 | Schmidt | |
| 2009/0025368 | A1 | 1/2009 | Sakimoto et al. | |
| 2010/0170460 | A1 * | 7/2010 | Leone et al. | 123/90.16 |

FOREIGN PATENT DOCUMENTS

EP 0448769 A1 7/1990

OTHER PUBLICATIONS

Moetakef, Mohammad Ali et al., "Exhaust System Having a Flow Rotation Element and Method for Operation of an Exhaust System," U.S. Appl. No. 13/897,223, 22 pages.

* cited by examiner

*Primary Examiner* — Audrey K Bradley
*Assistant Examiner* — Dapinder Singh
(74) *Attorney, Agent, or Firm* — Julia Voutyras; Alleman Hall McCoy Russell & Tuttle LLP

(57) ABSTRACT

An exhaust system in an engine is provided. The exhaust system includes an exhaust manifold include at least one exhaust runner having an inlet and a flow rotation element including at least one vane, the flow rotation element positioned in the inlet of the exhaust runner swirling exhaust airflow entering the exhaust runner.

20 Claims, 5 Drawing Sheets

EXHAUST SYSTEM HAVING A FLOW ROTATION ELEMENT AND METHOD FOR OPERATION OF AN EXHAUST SYSTEM

FIELD

The present disclosure relates to an exhaust system including flow rotation elements and a method for operation of an exhaust system including flow rotation elements.

BACKGROUND AND SUMMARY

Exhaust systems receive exhaust gas generated as a product of combustion carried out in cylinders in internal combustion engines. The exhaust systems may include exhaust manifolds which receive exhaust gas from individual cylinders in the engine and merge the exhaust gas flow into a single exhaust passage. The intake manifold may be positioned external to a cylinder head in the engine or integrated into the cylinder head. Due to packaging constraints the exhaust manifolds as well as other exhaust conduits in the exhaust system may include a number of bends, curves, etc., which may increase back pressure and generate noise, vibration, and harshness (NVH) in the exhaust system.

US 2009/0007552 discloses an exhaust manifold including tubes enclosed by a housing defining an interior section of the exhaust manifold. The inventors have recognized several drawbacks with the exhaust manifold disclosed in US 2009/0007552. For instance, the exhaust manifold disclosed in US 2009/0007552 is bulky, which increases the profile of the exhaust system. Moreover, the exhaust manifold disclosed in US 2009/0007552 also generates a large amount of NVH which may only be partially attenuated by the interaction between the tubes and the interior region. As a result, customer dissatisfaction is increased. Further, it will be appreciated that other exhaust manifold designs may involve tradeoffs between compactness, noise attenuation, and back pressure generation.

The inventors herein have recognized the above issues and developed an exhaust system in an engine. The exhaust system includes an exhaust manifold include at least one exhaust runner having an inlet and a flow rotation element including at least one vane, the flow rotation element positioned in the inlet of the exhaust runner swirling exhaust airflow entering the exhaust runner.

The flow rotation element decreases flow separation and turbulence in the exhaust gas flow through the exhaust manifold, thereby reducing impingement and noise generated in the exhaust manifold. As a result, NVH within the exhaust system is decreased and customer satisfaction is increased.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

BRIEF DESCRIPTION OF THE DRAWINGS

FIGS. 2-11 are drawn approximately to scale, however other relative dimensions may be used if desired.

DETAILED DESCRIPTION

An exhaust system having flow rotation elements positioned in inlets of exhaust runners in an exhaust manifold is described herein. The flow rotation elements are configured to generate flow rotation in the exhaust gas traveling through the exhaust manifold to reduce flow separation and turbulence in the exhaust manifold. As a result, exhaust flow impingement and noise generated in the exhaust manifold is reduced. Consequently, noise, vibration, and harshness (NVH) generated in the exhaust system is decreased thereby increasing customer satisfaction. Additionally, the likelihood of component degradation caused by NVH is reduced. The flow rotation elements include one or more vanes. In some examples, the vanes may extend in both an axial and a radial direction to generate the flow rotation. Specifically in one example, the vanes may be helically aligned to generate flow rotation.

Figure 1:
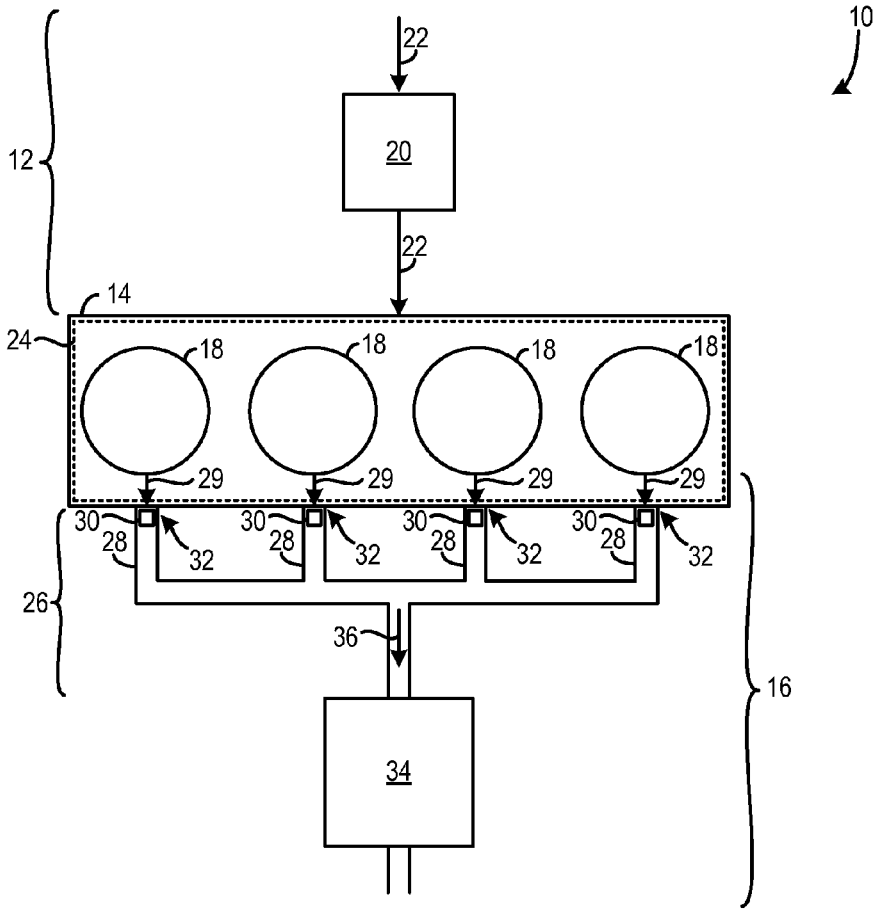
FIG. 1 shows a schematic depiction of an engine.

FIG. 1 shows a vehicle 10 including an intake system 12, an engine 14, and an exhaust system 16. The intake system 12 is configured to provide intake air to cylinders 18 in the engine 14. The intake system 12 includes a throttle 20. The throttle 20 may be positioned in an intake conduit. Arrows 22 depict the flow of air to and from the throttle 20. It will be appreciated that the intake system 12 may include additional components such as an air filter, compressor, a charge air cooler, an intake manifold, etc.

The engine 14 shown in FIG. 1 includes four cylinders in an inline configuration. However, an engine having an alternate number of cylinders and/or cylinder having different alignments have been contemplated. The engine 14 may include a cylinder head 24 coupled to a cylinder block (not shown) forming the cylinders.

The exhaust system 16 includes an exhaust manifold 26. The exhaust manifold 26 is positioned external to the cylinder head 24 in the depicted example. However, in other examples the exhaust manifold 26 may be integrated into the cylinder head 24. The exhaust manifold 26 includes a plurality of exhaust runners 28. Each of the exhaust runners 28 is in fluidic communication with exhaust passages 29, denoted via arrows, in the cylinder head 24. Flow rotation elements 30 are positioned in the inlets 32 of each of the exhaust runners 28. The exhaust manifold 26 is schematically depicted as having perpendicular bends. However, it will be appreciated that the exhaust manifold may have a different geometry with additional complexity, which is discussed in greater detail herein. For instance, the exhaust manifold may include curved bends.

The exhaust manifold 26 is coupled to an emission control device 34. The emission control device 34 may be a catalyst, particulate filter, etc. Thus, the emission control device 34 is positioned downstream of the exhaust manifold 26. Arrow 36 depicts the general flow of exhaust gas from the exhaust manifold 26 to the emission control device 34. It will be appreciated that the exhaust system may further include a turbine, additional emission control devices, a muffler, etc. Thus, any of the aforementioned components may be positioned downstream of the emission control device 34. Additionally, in some examples an exhaust conduit may be positioned between the exhaust manifold 26 and the emission control device 34. Furthermore, it will be appreciated that the exhaust system 16 may further include exhaust valves.

Figure 2:
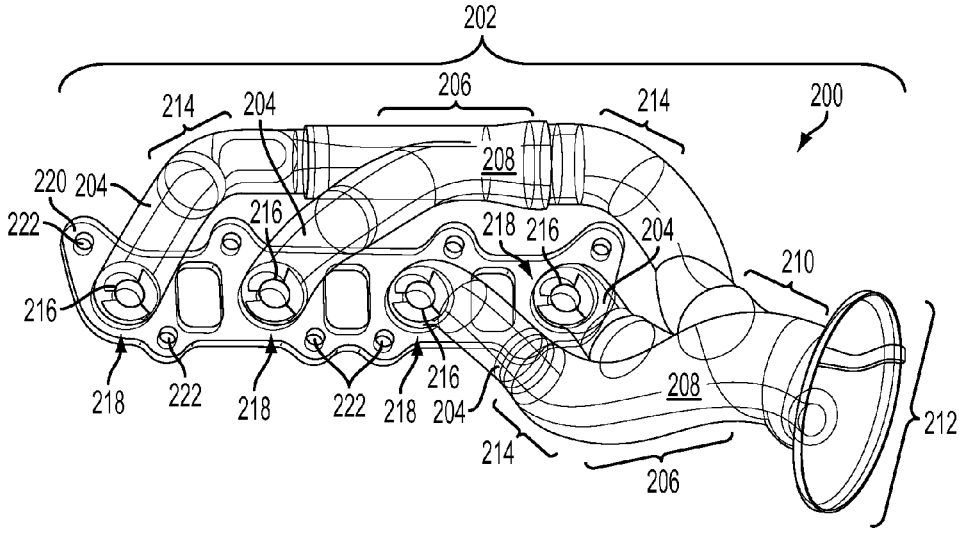
FIG. 2 shows an illustration of an example exhaust system including an exhaust manifold having flow rotation elements.

FIG. 2 shows a first example exhaust system 200 including an exhaust manifold 202. The exhaust system 200 shown in FIG. 2 may be the exhaust system 16 shown in FIG. 1. Therefore, the exhaust manifold 202 shown in FIG. 2 may be similar to the exhaust manifold 26 shown in FIG. 1. The exhaust manifold 202 includes a plurality of exhaust runners 204. Each of the exhaust runners 204 is configured to receive exhaust gas from exhaust passages in a cylinder head in an engine, such as the engine 14, shown in FIG. 1. Each of the exhaust runners 204 includes an inlet 218 having a central axis.

Pairs of exhaust runners merge at confluence sections 206 to form merged runners 208. The merged runners 208 again merge to form an outlet conduit 210. The outlet conduit 210 includes an outlet 212. The outlet 212 is not parallel to the inlets 218. However, other relative positions of the outlet 212 and the inlets 218 have been contemplated. The outlet conduit 210 may be coupled to a downstream emission control device, such as the emission control device 34, shown in FIG. 1.

The exhaust manifold 202 includes a plurality of bends 214 (e.g., curves) in the runners, conduits, etc. Flow rotation elements 216 are positioned in inlets 218 of the exhaust runners 204. The flow rotation elements 216 may be the flow rotation elements 30, shown in FIG. 1.

Continuing with FIG. 2, the flow rotation elements 216 generate flow rotation in the exhaust gas flowing into the exhaust manifold 202. Thus, the flow rotation elements are configured to swirl exhaust gas passing through the exhaust manifold. As a result, flow separation and turbulence in downstream sections of the exhaust manifold are reduced. Consequently, NVH caused by turbulence in the exhaust manifold may be reduced, thereby increasing customer satisfaction.

A cylinder head coupling interface 220 (e.g., cylinder head coupling flange) is also included in the exhaust manifold 202 shown in FIG. 2. The cylinder head coupling interface 220 includes coupling openings 222 configured to receive bolts or other suitable coupling apparatuses for coupling the exhaust manifold to a cylinder head, such as the cylinder head 24, shown in FIG. 1. However, in other examples another suitable coupling technique may be used to attach the exhaust manifold 202 to the cylinder head. It will be appreciated that additional components may be included in the exhaust system 200 shown in FIG. 2, such as the emission control device 34, depicted in FIG. 1.

Figure 3:
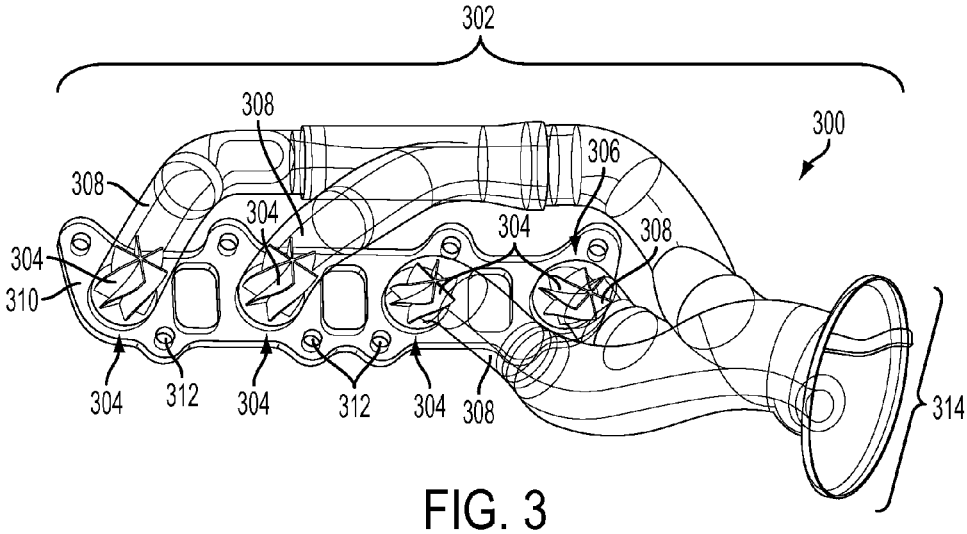
FIG. 3 shows an illustration of another example exhaust system including an exhaust manifold having flow rotation elements.
Figure 10:
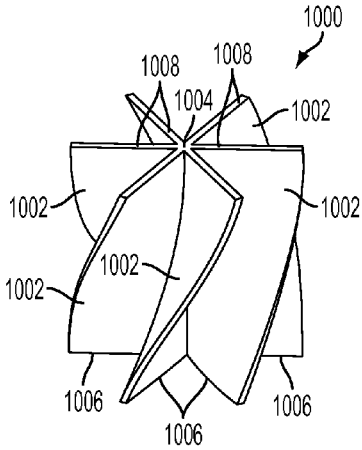
FIG. 10 shows one of the flow rotation elements depicted in FIG. 3.

FIG. 3 shows another exhaust system 300 including an exhaust manifold 302. The exhaust system 300 may be the exhaust system 16 shown in FIG. 1, in some examples. Additionally, the exhaust manifold 302 shown in FIG. 3 is similar in size and geometry to the exhaust manifold 202 shown in FIG. 2. However, flow rotation elements 304 positioned in inlets 306 of intake runners 308 are different from the flow rotation elements 216 shown in FIG. 2. A detailed view of one of the flow rotation elements 304 is shown in FIG. 10.

The exhaust manifold 302 also includes a cylinder head coupling interface 310. The cylinder head coupling interface 310 includes coupling openings 312 configured to receive bolts or other suitable coupling apparatuses for coupling to a cylinder head, such as the cylinder head 24, shown in FIG. 1. The exhaust manifold further includes an outlet 314 in fluidic communication with downstream components such as emission control devices, turbines, mufflers, exhaust conduits, etc. Flow rotation elements 304 are thus positioned downstream of cylinder exhaust valves in the cylinder head, but before exhaust ports from different cylinders are merged together in the exhaust manifold. In one example, rotation elements 304 may have one end (e.g., the inlet end) flush with the interface surface of the coupling interface 310, or recessed by a distance less than the diameter of the exhaust tube in which they are mounted. Further, a length along the flow direction of the flow rotation elements 304 may be less than the diameter of the exhaust tube or port in which they are positioned. As described further below, the vanes of a single flow rotation element may be affixed to one another to form a unitary element that is press-fit into position. Further, the mounting of a plurality of the vanes of a single flow rotation element may be at edges of a relatively planar vane to enable flexibility of the vanes with respect to one another or another internal structural element sufficient to enable the unit to be press-fit into position and held in place without welding or any other mounting elements. In some examples, the vanes may be positioned around an interior cylindrical tube, as described in detail below. In one example, each and every exhaust port of the exhaust manifold may include the same flow rotation element shape in the same position at the inlet, and upstream of merging regions of the exhaust manifold. However, in other example, only one or less then all of the exhaust ports of the exhaust manifold may include a flow rotation element. For example, longer ports may include the flow rotation element, while shorter ports do not, or vice versa.

Figure 4:
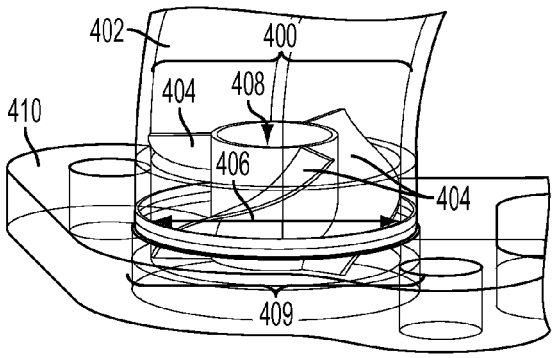
FIG. 4 shows one of the exhaust runners and flow rotation elements included in the exhaust manifold illustrated in FIG. 2.

FIG. 4 shows a detailed view of a flow rotation element 400 included in the plurality of flow rotation elements 216 positioned in an exhaust runner 402 included in the plurality of exhaust runners 204 shown in FIG. 2. The flow rotation element 400 shown in FIG. 4 is radially aligned. The flow rotation element 400 is at least partially enclosed by the exhaust runner 402. The flow rotation element 400 is coupled to the exhaust runner 402. The flow rotation element 400 includes a plurality of vanes 404, shown in greater detail in FIGS. 7 and 8, discussed in greater detail herein. A suitable coupling technique such as welding, press fitting, etc., may be used to attach the flow rotation element 400 to the exhaust runner 402. The flow rotation element 400 includes a tubular flow path 408. The tubular flow path 408 may be axially aligned with the inlet 409 of the exhaust runner 402.

An inner diameter 406 of the exhaust runner 402 is also illustrated in FIG. 4. The cylinder head coupling interface 410 is also shown in FIG. 4. As previously discussed, the cylinder head coupling interface may be coupled to a cylinder head.

Figure 5:
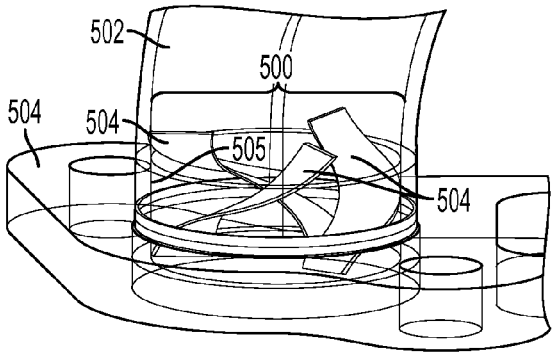
FIG. 5 shows an example exhaust runner and flow rotation element.

FIG. 5 shows a detailed view of an example flow rotation element 500 and exhaust runner 502. As shown, the flow rotation element 500 includes a plurality of vanes 504 spaced away from one another. Each of the vanes 504 may be coupled to an interior surface 505 of the exhaust runner 502. As previously discussed, a suitable coupling technique such as welding, press fitting, etc., may be used to attach the flow rotation element 500 to the exhaust runner 502. A cylinder head coupling interface 504 (e.g., cylinder head coupling flange) is also shown in FIG. 5. As previously discussed the cylinder head coupling interface may be coupled to a cylinder head.

Figure 6:
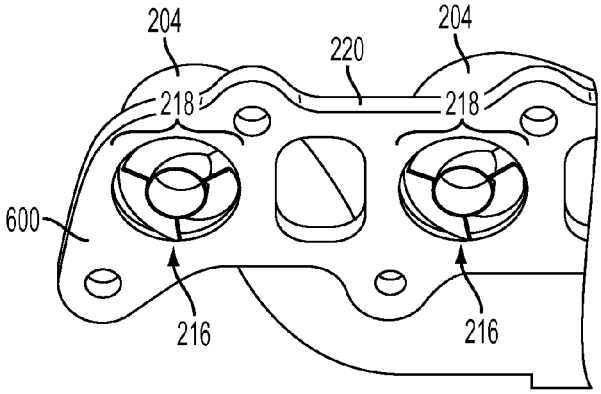
FIG. 6 shows another view of a portion of the exhaust manifold depicted in FIG. 2.

FIG. 6 shows a detailed view of the flow rotation elements 216 positioned in inlets 218 of the exhaust runners 204, shown in FIG. 2. The cylinder head coupling interface 220 (e.g., cylinder head coupling flange) is also shown in FIG. 5. The cylinder head coupling interface 220 include a planar external surface 600 in the depicted example which may be in face sharing contact with a cylinder head.

Figure 7:
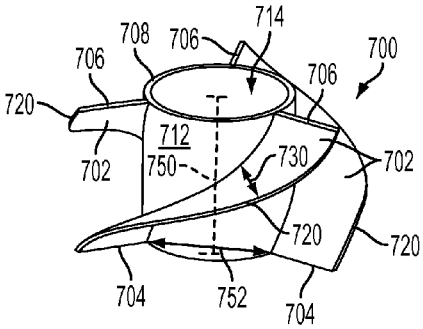
FIGS. 7 and 8 show one of the flow rotation elements included in the exhaust system shown in FIG. 2.
Figure 8:
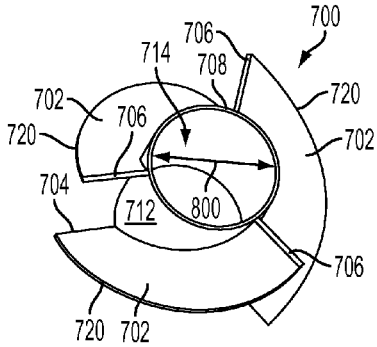

FIGS. 7 and 8 shows a first example flow rotation element 700. The flow rotation element 700 shown in FIGS. 7 and 8 includes a plurality of vanes 702. Each of the vanes 702 extend in an axial and radial direction. Specifically, the vanes may extend is a radial and axial direction with regard to a central axis of one of the inlets 218 shown in FIG. 2. As shown in FIG. 8 the vanes 702 are head-to-tail and do not radially overlap. However, in other examples the vanes may radially overlap. In this way, each of the vanes may extend around different radial ranges in the inlet of the exhaust runner. The vanes 702 may be helically arranged. Therefore, a separation 752, shown in FIG. 7 between adjacent vanes may not vary along the length of the vanes.

Furthermore, each of the vanes 702 includes a leading edge 704 and a trailing edge 706, shown in FIGS. 7 and 8. The leading and the trailing edges for each vane are offset from one another. Specifically, the leading edge of the vane may be offset from the trailing edge of the vane by 120 degrees.

The flow rotation element 700 also includes a tubular structure 708. The vanes 702 are coupled to an outer surface 712 of the tubular structure. Additionally, the tubular structure has a tubular geometry which defines an interior tubular flow path 714. The tubular structure 708 has an inner diameter 800, shown in FIG. 8. A ratio between the inner diameter 800 of the tubular structure 708 and the inner diameter 406 of the inlet 409 of the exhaust runner 402, shown in FIG. 4, may be 0.5-0.8. It will be appreciated that the size of the interior tubular flow path 714 may be used to adjust the amount of flow rotation provided to the exhaust gas.

A ratio between the inner diameter 800 of the tubular structure 708 and an axial length 750, shown in FIG. 7, of the tubular structure 708 may be 0.75-3. Additionally, each of the vanes 702 shown in FIGS. 7 and 8 are identical in size and geometry. However, vanes having differing sizes and/or geometries have been contemplated.

Each of the vanes 702 also includes a peripheral edge 720. The peripheral edges 720 may be coupled (e.g., welded, press fit, etc.) to an inner surface of one of the exhaust runners 204, shown in FIG. 2.

Additionally, a width 730 of one of the vanes 702 is shown in FIG. 7. A ratio between the inner diameter 800 shown in FIG. 8 and the width 730 may be 10-60.

Figure 9:
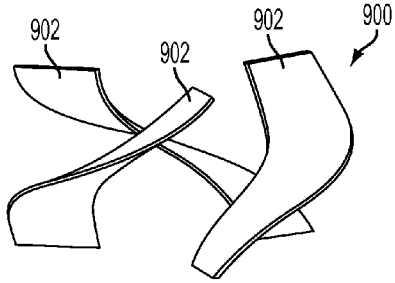
FIG. 9 shows the flow rotation element depicted in FIG. 5.

FIG. 9 shows the flow rotation element 900 depicted in FIG. 5. The flow rotation element 900 includes vanes 902 spaced away from one another. The vanes 902 are similar in geometry and size and are similar to the vanes 702 shown in FIGS. 7 and 8. However, the vanes 902 are spaced away from one another and not coupled to a tubular structure in FIG. 9.

FIG. 10 shows a flow rotation element 1000 included in the plurality of flow rotation elements 304 depicted in FIG. 3. The flow rotation element 1000 includes a plurality of vanes 1002. Each of the vanes is coupled (e.g., welded) at a central axially aligned interface 1004. The vanes 1002 depicted in FIG. 10 are identical in size and geometry. Additionally, each of the vanes 1002 shown in FIG. 10 includes a leading edge 1006 and a trailing edge 1008. The leading edges and trailing edges are radially aligned. Furthermore, an angle formed between the leading edge and trailing edge of each vane is 30 degrees.

Figure 11:
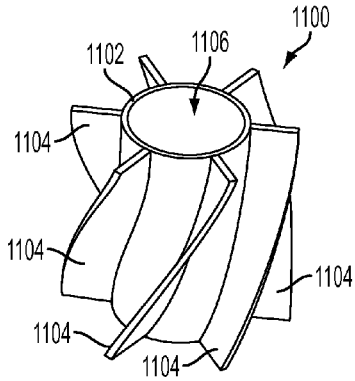
FIG. 11 shows another example flow rotation element.

FIG. 11 shows an example flow rotation element 1100. It will be appreciated that the flow rotation element 1100 shown in FIG. 10 may be positioned in an exhaust runner included in an exhaust manifold, such as the exhaust manifolds shown in FIGS. 3 and 4. The flow rotation element 1100 depicted in FIG. 11 includes a tubular structure 1102. A plurality of vanes 1104 are coupled to the tubular structure 1102. The tubular structure 1102 defines a boundary of an interior tubular flow path 1106.

Figure 12:
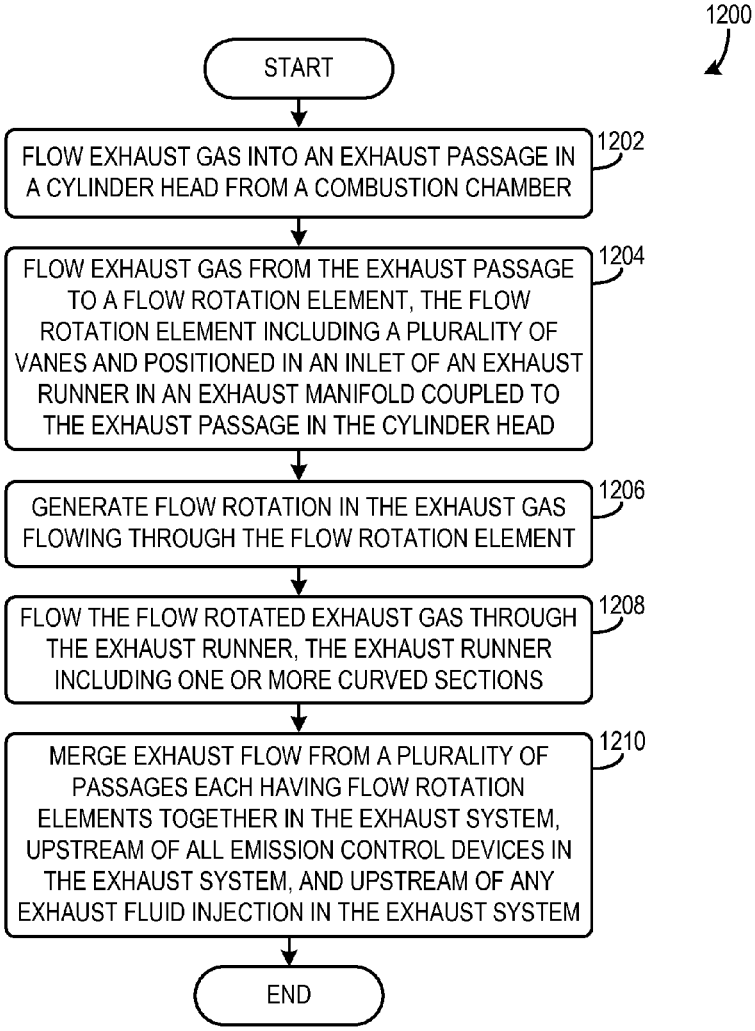
FIG. 12 shows a method for operation of an engine exhaust system.

FIG. 12 shows a method 1200 for operation of an exhaust system. Method 1200 may be implemented via the exhaust systems discussed above with regard to FIGS. 1-11 or may be implemented by other suitable exhaust systems.

At 1202 the method includes flowing exhaust gas into an exhaust passage in a cylinder head from a combustion chamber. Next at 1204 the method includes flowing exhaust gas from the exhaust passage to a flow rotation element, the flow rotation element including a plurality of vanes and positioned in an inlet of an exhaust runner in an exhaust manifold coupled to the exhaust passage in the cylinder head.

At 1206 the method includes generating flow rotation in the exhaust gas flowing through the flow rotation element. In this way, flow rotation may be generated in exhaust gas at the inlet of the exhaust manifold. As a result, impingement and noise generation in the exhaust manifold may be reduced, thereby improving customer satisfaction.

Next at 1208 the method includes flowing the flow rotated exhaust gas through the exhaust runner, the exhaust runner including one or more curved sections. In one example, the vanes are helically arranged. Further in one example, the flow rotation element includes a tubular structure including an exterior surface coupled to interior edges of the plurality of vanes.

Next at 1210 the method includes merging exhaust flow from a plurality of passages each having flow rotation elements together in the exhaust system, upstream of all emission control devices in the exhaust system, and upstream of any exhaust fluid injection in the exhaust system. It will be appreciated that the passages may be exhaust runners in the exhaust manifold.

Note that the example routines included herein can be used with various engine and/or vehicle system configurations. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first"

element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust system in an engine, comprising:

an exhaust manifold including at least one exhaust runner having an inlet coupled to a cylinder head; and a flow rotation element including at least one vane, the flow rotation element positioned in the inlet of the exhaust runner swirling exhaust airflow entering the exhaust runner.

2. The exhaust system of claim 1, where the exhaust runner includes curved section downstream of the inlet.

3. The exhaust system of claim 1, where the exhaust manifold includes a cylinder head coupling interface coupled to a cylinder head.

4. The exhaust system of claim 1, where the exhaust manifold is positioned external to a cylinder head in the engine.

5. The exhaust system of claim 1, where the flow rotation element is welded to the inlet of the exhaust runner.

6. The exhaust system of claim 1, where the flow rotation element includes a plurality of vanes.

7. The exhaust system of claim 6, where the vanes extend in a radial and axial direction with regard to a central axis of the exhaust manifold inlet.

8. The exhaust system of claim 6, where the vanes are helically arranged.

9. The exhaust system of claim 6, where the plurality of vanes are coupled to one another at a central axially aligned interface.

10. The exhaust system of claim 6, where the vanes have a similar size and geometry.

11. The exhaust system of claim 6, where the vanes overlap in a radial direction.

12. The exhaust system of claim 6, where the plurality of vanes are coupled to an exterior surface of a tubular structure included in the flow rotation element.

13. The exhaust system of claim 12, where a ratio between an inner diameter of the tubular structure and an axial length of the tubular structure is 0.75-3.

14. A method for an engine exhaust system, comprising:

flowing exhaust gas into an exhaust passage in a cylinder head from a combustion chamber;

flowing exhaust gas from the exhaust passage to a flow rotation element, the flow rotation element including a plurality of vanes and positioned in an inlet of an exhaust runner in an inlet of an exhaust manifold coupled to the cylinder head; and generating flow rotation in the exhaust gas flowing through the flow rotation element.

15. The method of claim 14, where the vanes are helically arranged.

16. The method of claim 14, where the flow rotation element includes a tubular structure including an exterior surface coupled to interior edges of the plurality of vanes.

17. The method of claim 14, further comprising flowing the flow rotated exhaust gas through the exhaust runner, the exhaust runner including one or more curved sections, and merging exhaust flow from a plurality of passages each having flow rotation elements together in the exhaust system, upstream of all emission control devices in the exhaust system, and upstream of any exhaust fluid injection in the exhaust system.

18. An exhaust system in an engine, comprising:

an exhaust manifold including at least one exhaust runner having an inlet coupled to a cylinder head; and a flow rotation element including a plurality of vanes, the flow rotation element positioned in the inlet of the exhaust runner swirling exhaust airflow entering the exhaust runner.

19. The exhaust system of claim 18, where each of the plurality of vanes are spaced away from one another.

20. The exhaust system of claim 18, where each of the vanes extend around different radial ranges.

* * * * *